United States Patent [19]

Barnhurst

[11] Patent Number: 4,965,046

[45] Date of Patent: Oct. 23, 1990

[54] CREEP RESISTANT ZINC-ALUMINUM BASED CASTING ALLOY

[75] Inventor: Robert J. Barnhurst, Pointe-Claire, Canada

[73] Assignee: Noranda Inc., Toronto, Canada

[21] Appl. No.: 333,894

[22] Filed: Apr. 6, 1989

[30] Foreign Application Priority Data

Oct. 4, 1988 [CA] Canada ..... 579310

[51] Int. Cl.[5] ..... C22C 18/04

[52] U.S. Cl. ..... 420/519; 420/516

[58] Field of Search ..... 420/516, 519

[56] References Cited

U.S. PATENT DOCUMENTS

| | | | |
|---|---|---|---|
| 1,596,761 | 8/1926 | Peirce et al. | 420/519 |
| 1,815,479 | 7/1931 | Morell | 420/516 |
| 3,850,622 | 11/1974 | Balliett | 420/516 |
| 4,126,450 | 11/1978 | Lathrop et al. | 420/516 |
| 4,731,129 | 3/1988 | Purnell | 420/516 |

FOREIGN PATENT DOCUMENTS

| | | | |
|---|---|---|---|
| 775207 | 5/1972 | Belgium | 420/516 |
| 332049 | 7/1936 | Italy | 420/519 |
| 46-3857 | 1/1971 | Japan | 420/519 |
| 512758 | 11/1937 | United Kingdom | 420/516 |
| 526619 | 9/1940 | United Kingdom | 420/519 |

*Primary Examiner*—Theodore Morris
*Assistant Examiner*—Robert R. Koehler
*Attorney, Agent, or Firm*—Fleit, Jacobson, Cohn, Price, Holman & Stern

[57] ABSTRACT

A creep resistant zinc-aluminum based casting alloy comprises in weight percent 3–18% aluminum, 0.01–0.15% magnesium, 0.01–0.05% or manganese or manganese and lithium in the concentrations between 0.01–0.05% Mn and 0.02–0.1% Li, the balance being zinc except for impurities commonly found in zinc alloys.

9 Claims, 2 Drawing Sheets

CREEP RESISTANT ZINC-ALUMINUM BASED CASTING ALLOY

This invention relates to a zinc-aluminum based casting alloy having good creep resistance, particularly at elevated temperatures up to 150° C.

It is widely known that a number of zinc-aluminum casting alloys are available with satisfactory room temperature creep resistance. These include alloys such as no. 3 (Zamak 3), no. 5 (Zamak 5), ZA-8, ZA-12 and ZA-27. However, the creep resistance of such zinc-aluminum casting alloys is poorer at elevated temperatures up to 150° C., as compared to aluminum alloys.

It is therefore the object of the present invention to provide a zinc-aluminum based casting alloy having a good creep resistance at elevated temperature. The invention also deals with the development of a zinc-aluminum based casting alloy that has the properties and foundry advantages, including the hot chamber die castability of the lower aluminum containing alloys, of the present ZA family (ZA-8, ZA-12, ZA-27).

The zinc-aluminum based casting alloy in accordance with the present invention comprises in weight percent 3–18% aluminum, 0.01–0.15% magnesium, 0.01–0.05% manganese or manganese and lithium in the concentrations between 0.01–0.05% Mn and 0.02–0.1% Li, the balance being zinc except for impurities commonly found in zinc alloys.

In the above alloy, copper is usually present in an amount of up to 2.5%, preferably 0.5 to 2.5%, for strength and corrosion resistance.

The aluminum content of the above zinc-aluminum based casting alloy is preferably between about 6 and 12%, most preferably between about 8 and 10%.

Both manganese and lithium within the concentrations mentioned above are preferably present in the above zinc-aluminum based casting alloy.

The manganese content of the above zinc-aluminum casting alloy is preferably between about 0.01 and 0.025%.

The lithium content of the above zinc-aluminum based casting alloy is preferably between about 0.05 and 0.07%.

The invention will now be disclosed in more detail with reference to the accompanying drawings in which.

Figure 1:
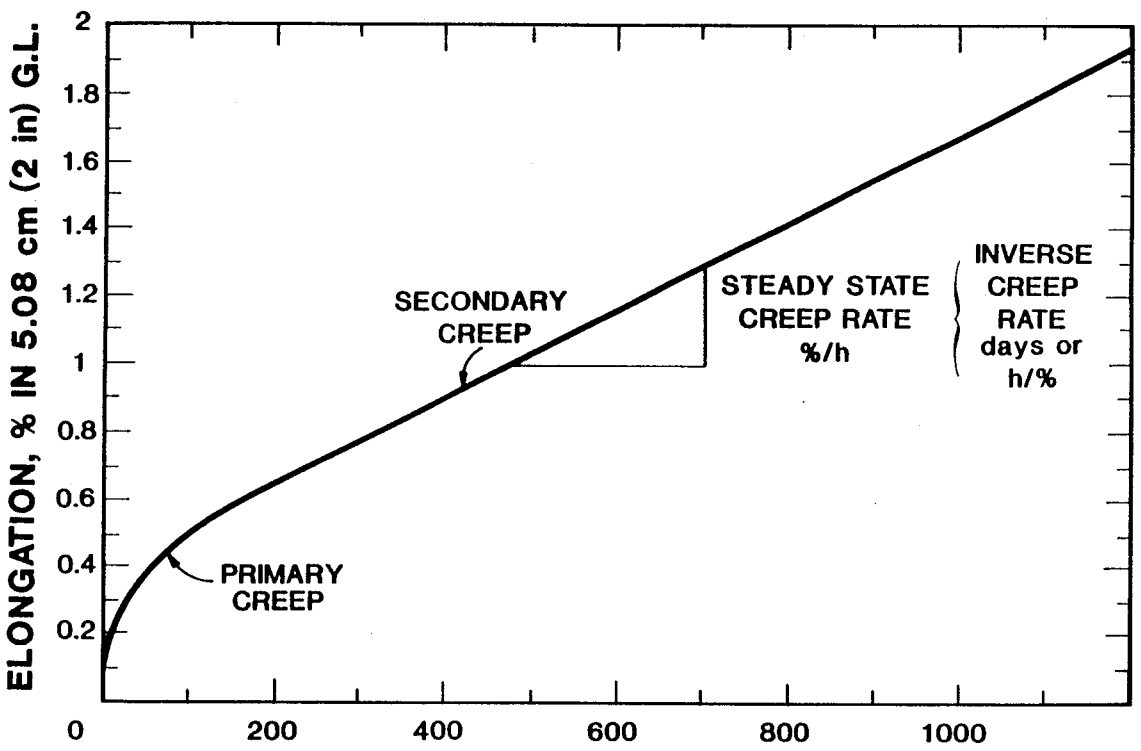
FIG. 1 shows the parameters which are determined creep deformation curves.

The creep resistance of any metal is judged depending on its performance in the three phases of creep, viz primary, secondary and tertiary. Only primary and secondary creep properties are of engineering importance and are shown in FIG. 1. The primary creep resistance of zinc-aluminum alloys is of prime concern where short term performance is critical, while secondary creep resistance is of more concern at longer times, as would be found in most engineering structures. In some instances both primary and secondary creep properties are of equal importance.

Typical creep rates of the zinc-aluminum based casting alloys produced by a variety of processes, are given in the following Table 1.

TABLE 1

Maximum Allowable Design Stress (MPa*) in Tension for Zinc-Aluminum Foundry Alloys Produced by Different Processes to Produce a Secondary Creep Rate of 0.01% in 1000h or less

| Alloy | 20° C. | 100° C. | 150° C. |
|---|---|---|---|
| ZA-8 Permanent Mould | ≈70 | — | ≈4 |
| ZA-8 Press. Die Cast | ≈70 | ≈7 | — |
| ZA-12 Sand Cast | ≈70 | ≈9 | ≈3.5 |
| ZA-12 Press. Die Cast | ≈70 | — | — |
| ZA-27 Sand Cast | ≈76 | ≈10 | ≈5 |
| ZA-27 Press. Die Cast | ≈70 | ≈9 | — |
| ILZRO 16 | ≈95 | ≈28 | ≈5 |
| Die Cast Alloy #3 | ≈20 | — | — |

*Some data is based on extrapolation

As noted in the above table, the creep resistance of the alloys mentioned is poorer at a temperature of 150° C. than at 20° C. The data for ILZRO 16, a Zn-Cu-Ti-Cr alloy with a very small amount of aluminum-(<0.04%), is shown for comparison purposes. ILZRO 16 is the most creep resistant zinc alloy presently known, particularly at elevated temperature, although it is produced commercially only in small quantities. Difficulties with this alloy, including its manufacture, relatively poor melt stability and lack of suitability for hot chamber die casting (where the melt is in direct contact with the unprotected iron-based pumping system), have been the chief reasons for ILZRO 16 proving unpopular in the die casting industry.

The primary and secondary creep resistance of a conventional ZA-8 alloy containing typically 8.4% aluminum, 1.0% copper, 0.025% magnesium, the balance being zinc, and of several similar ZA-8 alloys (except for a higher magnesium content of 0.1%) containing specified amounts of manganese, lithium or manganese and lithium are shown in the following Table 2.

TABLE 2

Primary and Secondary Creep of the New Alloy * Compared to ZA-8**

| Primary Alloy | Time, h, to designated % elongation | | | |
|---|---|---|---|---|
| Alloy | 0.25% | 0.5% | 0.75% | 1.0% |
| ZA-8 | 4 | 14 | 26 | 37 |
| ZA-S + 0.056% Li | 9 | 46 | 101 | 160 |
| ZA-8 + 0.018% Mn | 15 | 44 | 95 | 168 |
| ZA-S + 0.041% Mn | 4 | 17 | 31 | 47 |
| ZA-S + (0.06% Li/0.013% Mn) | 23 | 113 | 238 | 379 |
| ZA-S + (0.07% Li/0.025% Mn) | 88 | 288 | — | — |

| Secondary Alloy | Creep rate in % per 1000h |
|---|---|
| ZA-8 | 21 |
| ZA-8 + 0.056% Li | 3.67 |
| ZA-8 + 0.018% Mn | 1.81 |
| ZA-8 + 0.041% Mn | 16.8 |
| ZA-8 + (0.06% Li/0.013% Mn) | 1.74 |
| ZA-8 + (0.07% Li/0.025% Mn) | 1.57 |

*All alloys contain 0.1 Mg, with the exception of normal ZA-8 without additions
**All tests conducted at a stress of 35 MPa/ 100° C. on standard Pressure Die Cast testpieces conforming to ASTM E8-85

Figure 2:
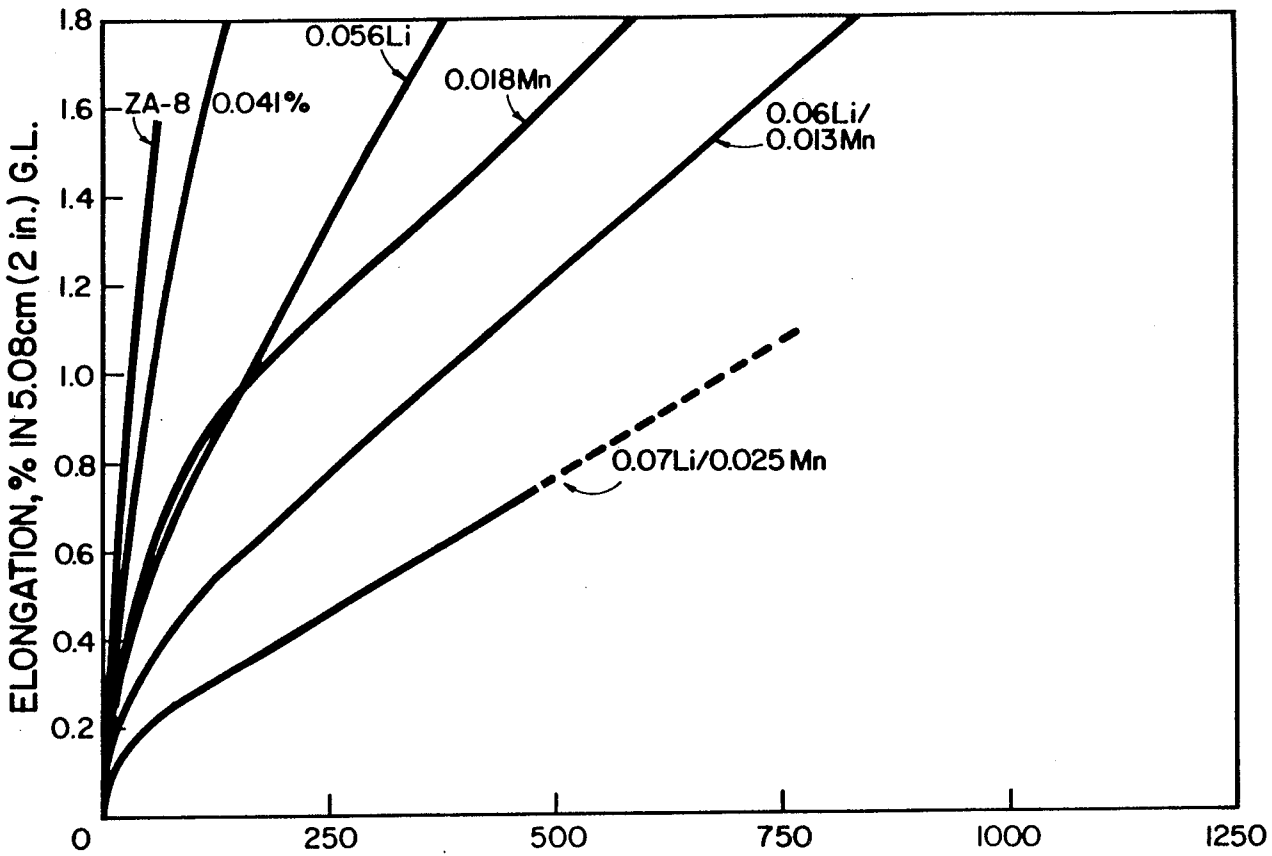
FIG. 2 shows the percent elongation versus time of various specimens of zinc-aluminum alloys in accordance with the invention.

Test data at 100° C. and a stress of 35 MPa are provided for the pressure die cast condition, with a comparison to the conventional ZA-8 alloy for the same test conditions. The ZA-8 alloy shows the highest combination of both primary and secondary creep resistance of the present ZA family. From the test data given in Table 2 and shown in FIG. 2, it may be seen that greatly superior primary and secondary creep resistance are obtained when both manganese and lithium are added to the zinc-aluminum based alloy. However, a substantial improvement in primary and secondary creep resistance is also obtained in adding manganese alone. These data are for the pressure die cast condition but the new alloy provides for the same or superior performance in the creep resistance of the gravity cast forms. The highest need is for a pressure die cast alloy capable of production in the hot chamber mode at the least cost premium compared to the present ZA alloys.

Work at Centre de Recherches Métallurgiques (CRM), Belgium (UK Patent No. 1,337,937) led to definition of a super-plastic zinc alloy containing from 19–24%Al, Cu up to 1% and/or Mg from 0.02–0.1%, Cr from 0.001 to 0.5% and/or Li from 0.001 to 0.5% and/or Zr from 0.001 to 1%. The objective of this work was to develop a superplastic alloy with good room temperature creep resistance. This alloy uses lithium alone to improve creep resistance and is also outside the scope of the present invention in terms of aluminum content. The creep rate in this alloy containing Li is of the order of 0.38%/h at 22° C. and a stress of 69 MPa (10,000 psi), which, especially at 100° C. is several orders of magnitude higher than that of the zinc-aluminum based casting alloy on which the present invention is based.

Belgian Patent No. 775207 issued to CRM discloses zinc-aluminum alloy containing a small amount of lithium to improve creep resistance. The patent also refers to a number of other metals including Be, Co, Cr, Mn, Ti, Zr being present in concentrations lower than 0.25% but these metals are present as impurities and not added for specific purposes.

Later work at CRM included development of a creep resistant alloy (FR Patent No. 80 26139) containing up to 2% A1 and manganese in the range of 0.025 to 0.8%. A later improvement (BE Patent No. 892733) disclosed a similar alloy with the addition of 0.01–0.06% Ti, Zr, Ni, V, Cr, Be, Ca, rare earths or misch metal. The aluminum content of both the above alloys is outside the scope of the present invention.

U.S. Pat. No. 3,527,601 assigned to Dow Chemical discloses the making of a creep resistant zinc base alloy containing one of 19 additive elements including Li and Mn. However, the Li range is from 0.1 to 0.5% and Mn at 0.3 to 1.5% which is well beyond that of the present invention. The alloys are fabricated from atomized droplets into pellets and hot worked, and are not designed as casting alloys.

The alloy has been produced to date in both channelless induction furnaces and gas-fired furnaces, although any type of melting furnace presently, used to melt ZA alloys would be suitable.

The procedure for producing the alloy is as follows:

An homogeneous zinc-aluminum-copper melt is produced. A master alloy containing Al and Li is then added with the manganese and magnesium. It is important that the Al—Li addition be added sub-surface, to avoid loss of lithium from the bath. The bath is vigorously stirred whereupon the bath is adjusted to a holding or casting temperature not exceeding approximately 600° C. The metal is then ready for casting directly from the melting furnace or from a holding furnace provided the bath is skimmed according to normal practice for zinc alloys.

A loss of lithium from the melt is to be expected over a period of time in situations where lithium is not constantly (as fresh ingot) added to the melting pot as metal is consumed during casting. Adjustment to the bath chemistry may be required to compensate for the loss of lithium.

In general, the present invention relates to improvements of both primary and secondary creep resistance by addition to zinc-aluminum alloys of manganese in predetermined proportions and particularly of manganese and lithium to achieve greatly superior creep resistance in such alloys. The invention should, therefore, not be limited to specific examples given herein, but only by the scope of the appended claims.

I claim:

1. A creep resistant zinc-aluminum based casting alloy consisting essentially of, in weight percent, 3–18% aluminum, 0.01–0.15% magnesium, and manganese and lithium in the concentrations between 0.01–0.05% Mn and 0.02–0.1% Li, the balance being zinc except for impurities commonly found in zinc alloys.

2. A creep resistant zinc-aluminum based casting alloy consisting essentially of, in weight percent, 3–18% aluminum, 0.01–0.15% magnesium, manganese and lithium in amounts of 0.01–0.05% manganese and 0.02–0.1% lithium, and cooper in an amount up to 2.5%, the balance being zinc except for impurities commonly found in zinc alloys.

3. A creep resistant zinc-aluminum based casting alloy as defined in claim 2, wherein the amount of copper is between 0.5 and 2.5%.

4. A creep resistant zinc-aluminum based casting alloy as defined in claim 1, wherein the aluminum concentration is between about 6 and 12%.

5. A creep resistant zinc-aluminum based casting alloy as defined in claim 4, wherein the aluminum concentration is between 8 and 10%.

6. A creep resistant zinc-aluminum based casting alloy as defined in claim 1, wherein the manganese content is between 0.01 and 0.025%.

7. A creep resistant zinc-aluminum based casting alloy as defined in claim 1, wherein the lithium content is between 0.05 and 0.07%.

8. A creep resistant zinc:-aluminum based casting alloy as defined in claim 2, wherein the aluminum concentration is between about 6 and 12%, copper concentration is between 0.5 and 2.5%, and wherein manganese is present in a content between 0.01 and 0.025% and lithium is present in a content of between 0.05 and 0.07%.

9. A creep resistant zinc-aluminum based casting alloy as defined in claim 2, wherein the aluminum concentration is between 8 and 10%, copper concentration is between 0.5 and 2.5% and wherein manganese is present in a content of between 0.01 and 0.025% and lithium is present in a content of between 0.05 and 0.07%.

* * * * *